US009526335B2

(12) United States Patent
Grossman et al.

(10) Patent No.: US 9,526,335 B2
(45) Date of Patent: Dec. 27, 2016

(54) FURNITURE OBJECTS INCLUDING HIDDEN CONTAINERS

(71) Applicant: Night and Day Furniture LLC, Vancouver, WA (US)

(72) Inventors: Joel Grossman, Petaling Jaya (MY); Howard Porter, Kuala Lumpur (MY); George Loo, Selangor (MY)

(73) Assignee: Night and Day Furniture, LLC, Vancouver, WA (US)

( * ) Notice: Subject to any disclaimer, the term of this patent is extended or adjusted under 35 U.S.C. 154(b) by 0 days.

(21) Appl. No.: 14/809,690

(22) Filed: Jul. 27, 2015

(65) Prior Publication Data

US 2016/0037920 A1 Feb. 11, 2016

Related U.S. Application Data

(60) Provisional application No. 61/999,874, filed on Aug. 8, 2014.

(51) Int. Cl.

| | |
|---|---|
| ***A47B 88/22*** | (2006.01) |
| ***A47B 97/00*** | (2006.01) |
| *A47B 17/04* | (2006.01) |

(52) U.S. Cl.

CPC ..... *A47B 88/22* (2013.01); *A47B 97/00* (2013.01); *A47B 17/04* (2013.01)

(58) Field of Classification Search

CPC ..... A47B 88/22; A47B 17/04
USPC ..... 312/204
See application file for complete search history.

(56) References Cited

U.S. PATENT DOCUMENTS

| | | | | | |
|---|---|---|---|---|---|
| 3,332,729 | A * | 7/1967 | Dickson | A47B 88/12 | 312/204 |
| 3,806,220 | A * | 4/1974 | Payne | A47B 27/00 | 108/13 |
| 4,113,332 | A * | 9/1978 | McMaster | A47B 88/22 | 109/54 |
| 4,252,387 | A * | 2/1981 | Wagner | A47B 17/04 | 312/204 |
| 5,048,901 | A * | 9/1991 | DeBlaay | A47B 67/04 | 312/204 |
| 5,230,551 | A * | 7/1993 | Kramer | A47B 67/04 | 312/204 |
| 5,727,291 | A * | 3/1998 | Biondo | A61G 17/04 | 27/1 |
| 5,944,396 | A * | 8/1999 | Stephan | A47B 88/22 | 312/204 |
| 9,173,488 | B1 * | 11/2015 | Bello | A47B 88/08 | |
| 2008/0211362 | A1 * | 9/2008 | Moll | A47B 88/22 | 312/204 |
| 2010/0079043 | A1 * | 4/2010 | Stefka | A47B 17/04 | 312/204 |

* cited by examiner

*Primary Examiner* — Daniel Rohrhoff
(74) *Attorney, Agent, or Firm* — Harness, Dickey & Pierce, P.L.C.

(57) ABSTRACT

A furniture apparatus including a frame; and a hidden container. The hidden container configured transition between an open state and a closed state, the hidden container being visible when the hidden container is in the open state, and the hidden container being hidden from view when the hidden container is in the closed state.

20 Claims, 12 Drawing Sheets

FURNITURE OBJECTS INCLUDING HIDDEN CONTAINERS

RELATED APPLICATIONS

The present application claims priority under 35 U.S.C. §119 to U.S. Provisional Application No. 61/999,874 filed on Aug. 8, 2014, the entire contents of which are hereby incorporated by reference in their entirety.

FIELD

The present disclosure relates generally to furniture objects including secret and/or hidden containers.

BACKGROUND

The statements in this section merely provide background information related to the present disclosure and may not constitute prior art.

Furniture objects and/or apparatuses capable of providing a storage function (e.g., chests, cabinets, coffers, bureaus, armoires, night stands, desks, and/or any other like furniture objects) typically include storage compartments and/or storage containers (e.g., drawers). Many users of storage based furniture objects and/or storage based furniture apparatuses wish to store objects that have a perceived value in a hidden and/or concealed fashion. However, most typical storage based furniture objects and/or storage based furniture apparatuses do not include compartments and/or containers that may be hidden from view.

SUMMARY

Example embodiments relate to a furniture object including at least one secret and/or hidden container.

Example embodiments provide that the furniture object may be a chest, cabinet, coffer, bureau, armoire, night stand, desk, or any other like furniture object that may be configured to include and/or contain a secret and/or hidden container.

Example embodiments provide that the secret and/or hidden container may be a drawer and/or any other like container that is configured as a storage space.

At least one example embodiment relates to a furniture apparatus.

In some example embodiments, the furniture apparatus may include a frame; and a hidden container configured transition between an open state and a closed state, the hidden container being visible when the hidden container is in the open state, and the hidden container being hidden from view when the hidden container is in the closed state.

In some example embodiments, the furniture apparatus may include an unhidden container configured to be at least drawn out horizontally in a first direction from the frame when transitioning from the closed state to the open state, the unhidden container being a container that is visible when in each of the open state and the closed state, the unhidden container removable from the frame by transitioning the unhidden container beyond the open state.

In some example embodiments, the hidden container is configured to be at least drawn out horizontally in the first direction from the frame when transitioning from the closed state to the open state.

In some example embodiments, the hidden container is configured to be at least drawn out horizontally in a second direction from the frame when transitioning from the closed state to the open state, and the first direction is a different direction from the second direction.

In some example embodiments, the unhidden container is configured to be received by an opening formed by a top portion of the frame, the top portion of the frame including a set of runners configured to allow the unhidden container to be at least drawn out horizontally, and the unhidden container forms a first enclosure with the top portion of the frame when the unhidden container is received by the opening, and the hidden container is configured to rest on a set of support ledges attached to a bottom portion of the frame.

In some example embodiments, one or more of the support ledges and the hidden container include a sliding mechanism configured to allow the hidden container to slide horizontally.

In some example embodiments, the hidden container includes one or more protruding members protruding from a body of the hidden container, the hidden container configured to selectively rest on the support ledges via the one or more protruding members.

In some example embodiments, when the hidden container rests on the support ledges, the hidden container forms a second enclosure underneath the first enclosure such that the second enclosure is hidden from view when the first enclosure is within the frame.

In some example embodiments, when resting in the opening, the one or more protruding members of the hidden container are configured to rest on the support ledges.

In some example embodiments, the unhidden container is one of a plurality of unhidden containers that each form a first enclosure, and the frame includes a plurality of openings therein each configured to receive a corresponding one of the plurality of unhidden containers, each of the plurality of unhidden containers being visible in each of the open state and the closed state.

In some example embodiments, at least one of the unhidden containers is removable from the frame, and the at least one hidden container is configured to draw out at least horizontally in a direction from the frame when changing from the closed state to the open state.

In some example embodiments, the at least one hidden container is configured to draw out in a different direction from the unhidden containers.

In some example embodiments, each of the plurality of openings includes a set of runners configured to allow each of the plurality of unhidden containers to be at least drawn out horizontally, and the at least one hidden container is configured to rest on support ledges attached to an undercarriage of the frame.

In some example embodiments, the at least one hidden container includes one or more protruding members protruding from a body thereof, the hidden container configured to selectively rest on the support ledges via the one or more protruding members.

In some example embodiments, when the at least one hidden container rests on the support ledges, the at least one hidden container forms a second enclosure underneath one of the first enclosures such that the second enclosure is hidden from view when the first enclosure is within the frame.

In some example embodiments, the one of the protruding members and a bottom surface of the hidden container are configured to rest on the support ledges.

Some example embodiments, the at least one hidden container is configured to attach to the support ledges.

Some example embodiments relate to a method of constructing a furniture apparatus including a hidden container, the hidden container being concealed from view when the hidden container is in a closed state.

In some example embodiments, the method may include installing a set of support ledges to an undercarriage of the furniture apparatus; and placing the hidden container on the set of runners such that the hidden container is hidden when viewing the furniture apparatus from a front perspective.

In some example embodiments, the furniture apparatus includes at least one unhidden drawer that is removable, and the hidden container is hidden when the at least one unhidden drawer is within a frame of the furniture apparatus.

Some example embodiments relate to a furniture apparatus.

In some example embodiments, the furniture apparatus includes a frame including an opening configured to receive an unhidden container and a hidden container, wherein the unhidden container is configured to selectively detach from the frame such that, when the unhidden container is attached to the frame, the hidden container is hidden from view inside the frame beneath the unhidden frame, and when the unhidden container is detached from the frame, the hidden container is exposed.

Further areas of applicability will become apparent from the description and figures provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DESCRIPTION

Figure 1:
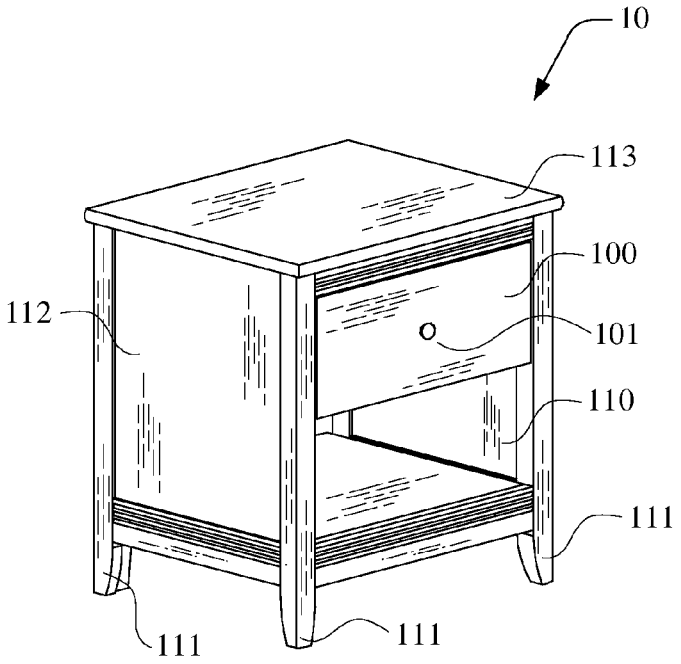
FIG. 1 is a front, right perspective view of a furniture apparatus including at least one secret and/or hidden container in a closed position according to an example embodiment.

The following description is merely example in nature and is not intended to limit the present disclosure, application, or uses. It should be understood that throughout the drawings, corresponding reference numerals indicate like or corresponding parts and features.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the example embodiments to those skilled in the art.

Example embodiments relate to a furniture apparatuses including at least one secret and/or hidden container. Example embodiments provide that the furniture apparatus may be a chest, a chest of drawers, a cabinet, a coffer, a bureau, an armoire, a night stand, a desk, or any other like furniture object or apparatus that may be configured to include and/or contain a secret and/or hidden container. Example embodiments provide that the secret and/or hidden container may be a drawer and/or any other like container that is configured as a storage space.

The furniture object including at least one secret and/or hidden container may be in a shape and configuration as shown by the accompanying figures. The furniture object including at least one secret and/or hidden container may be operated according to methods as shown by the accompanying figures.

Figure 2:
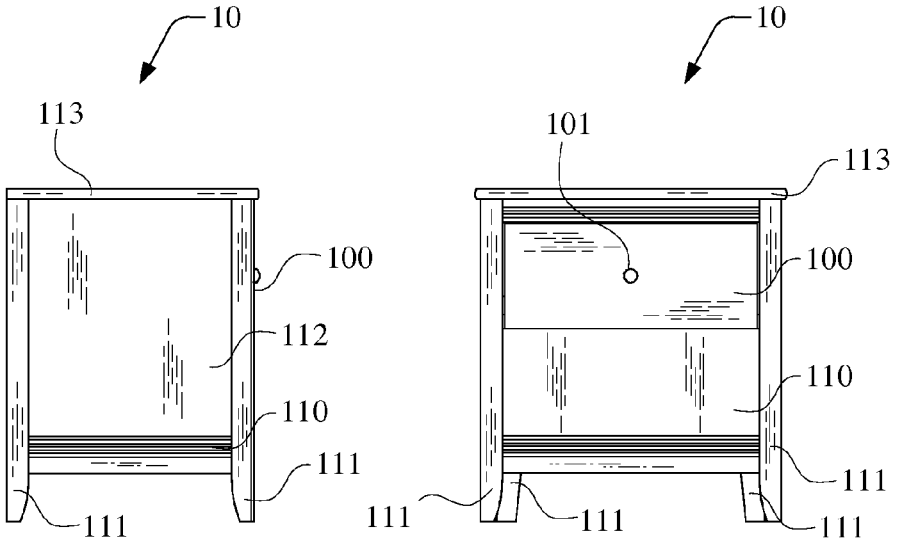
FIG. 2 is a side and front perspective view of the furniture apparatus including at least one secret and/or hidden container of FIG. 1.

FIG. 1 is a front, right perspective view of a furniture apparatus 10 including at least one unhidden container 100 and at least one secret and/or hidden container 105 in a closed position according to an example embodiment. FIG. 2 is a side and front perspective view of the furniture object including at least one secret and/or hidden container 100 of FIG. 1.

Referring to FIGS. 1 and 2, the furniture apparatus 10 includes an unhidden container 100, a hidden container (not shown), and frame 110. Further, in some example embodiments, the furniture apparatus 10 may include legs 111. However, example embodiments are not limited thereto, and in various other example embodiments, the legs 111 may be omitted.

The unhidden container 100 may include a handle 101. The frame 110 includes side panels 112 and a top surface 113. Together, the side panels 112 and top surface 113 of the frame 110 form an enclosure that holds or otherwise includes the unhidden container 100. Further, as discussed in more detail below, in some example embodiments, the enclosure may also hold the hidden container (. The legs 111 are configured to provide stability and/or support for the furniture apparatus 10.

As shown in FIGS. 1 and 2, the unhidden container 100 may be in a closed state. When in the closed state, the unhidden container 100 together with the top 113 forms an enclosure capable of storing objects.

Figure 3:
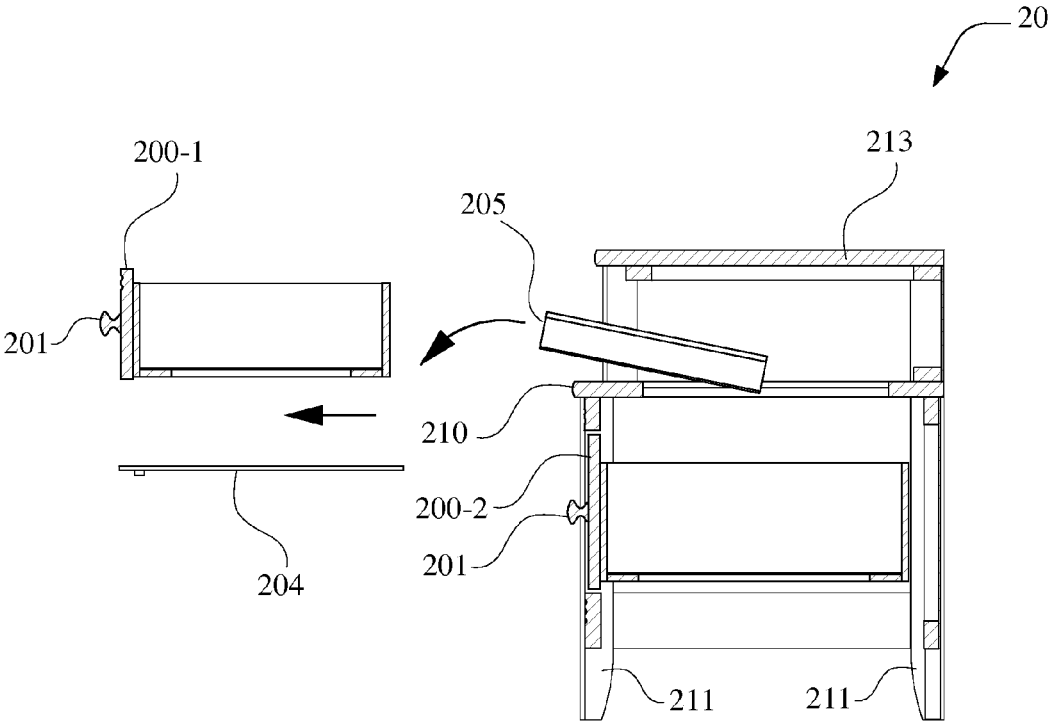
FIGS. 3 and 4 illustrate side sectional views of a furniture apparatus according to an example embodiment.
Figure 4:
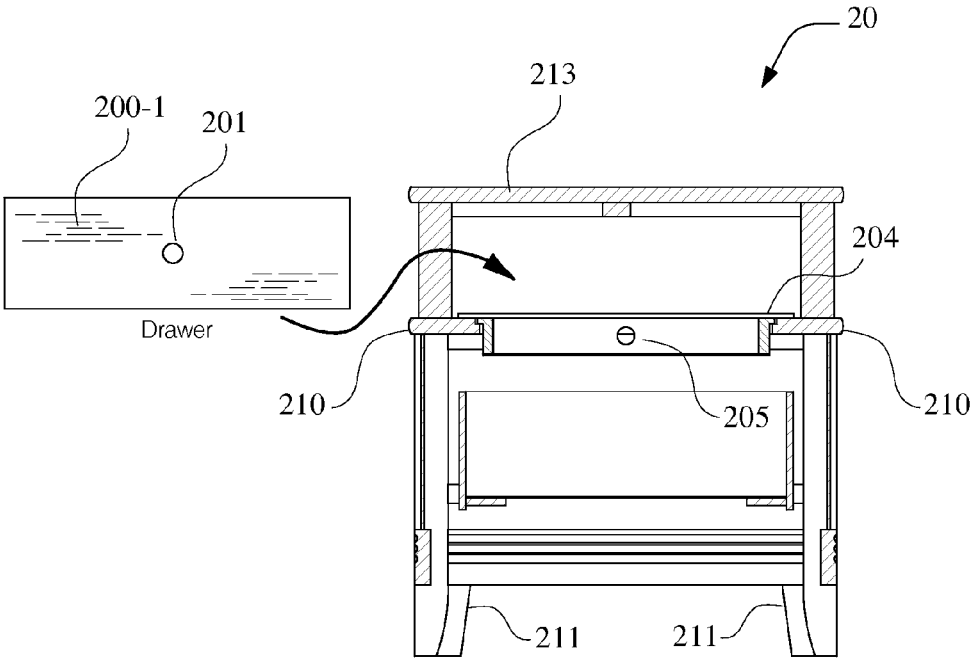
Figure 5:
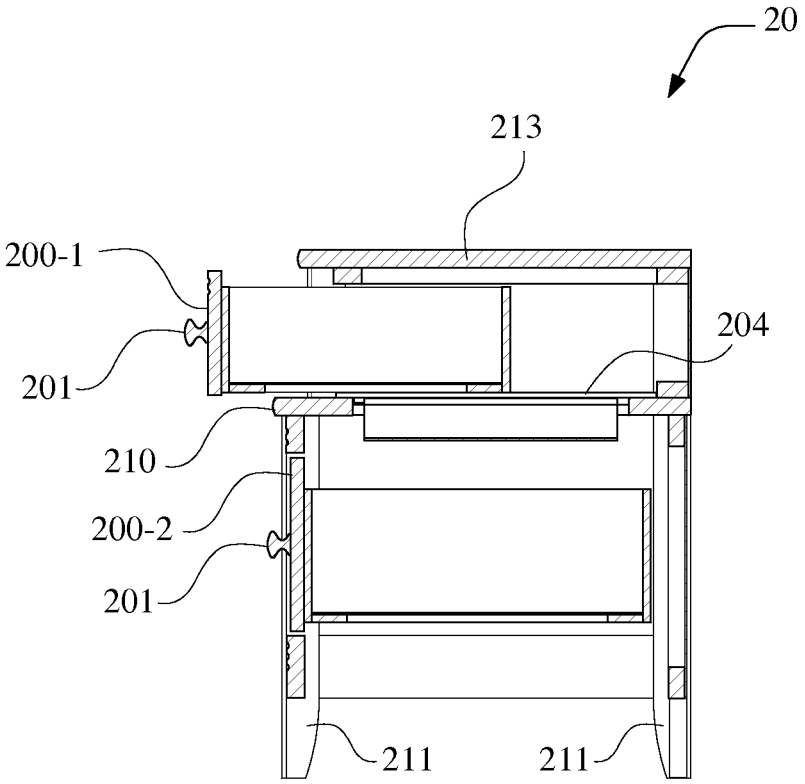
FIG. 5 illustrates a front sectional view of a furniture apparatus according to an example embodiment.

FIGS. 3 and 4 illustrate side sectional views of a furniture apparatus 20. FIG. 5 illustrates a front sectional view of the furniture apparatus 20 according to example embodiments.

Referring to FIGS. 3 to 5, a furniture apparatus 20 includes an unhidden container 200, a hidden container 205, and frame 210. Further, in some example embodiments, the furniture apparatus 20 may include legs 211, and the frame 210 may include side panels 212 and a top surface 213.

In some example embodiments, the unhidden container 200 may be removed to expose the hidden container 205, and the hidden container 205 may then be removed via grasping finger holes therein.

The unhidden container 200 and/or the hidden container 205 may be any container that fits into the furniture apparatus 20, and/or any other like object. The unhidden container 200 and/or the hidden container may be constructed, manufactured, or otherwise built in a variety of shapes include any rectangular shape, square shape, and the like. The furniture apparatus 20, the unhidden container 200, and/or the hidden container 205 may be constructed, manufactured, or otherwise built using a variety of materials, such as wood, plastic, metal, minerals and/or any combination thereof. In various embodiments, the unhidden container 200 may be designed such that a front face of the unhidden container 200 is flush with, or otherwise aligned with the side panels 212 when the unhidden container 200 is in the closed state.

The unhidden container 200 is configured to be drawn out horizontally from a frame of the furniture apparatus 20 when transitioning from the closed state to the open state. In the open state, a user of the furniture apparatus 20 may place objects inside the unhidden container 200.

In order to transition from the closed state to the open state (and vice versa), the furniture apparatus 20 may include sliders (not shown) upon which the unhidden container 200 slides as it is transitioned from the open state to the closed state and vice versa. The sliders may be friction sliders, ball-bearing sliders, roller-bearing sliders, progressive action slides, and/or any other like apparatus and/or mechanism that enables the unhidden container 200 to be drawn out and/or pushed in a substantially horizontal fashion. The sliders may be located within the enclosure formed by the frame 210 and/or the sliders may be attached to the unhidden container 200.

Additionally, the sliders and/or runners may be configured to allow the unhidden container 200 to detach/attach to the frame 210 such that the unhidden container 200 can be removed/inserted into the enclosure formed by the frame 210 to expose and hide the hidden container 205, respectively. It should also be noted that the unhidden container 200 may be placed in an open state using any other type of manipulation in addition to (or alternative to) a drawing-out motion.

The handle 201 of the unhidden container 200 may be any type of handle, knob, latch, hook, and/or any other like protrusion that facilitates the unhidden container 200 to transition from the closed state to the open state. In some embodiments, unhidden container 200 may include any another type of mechanism by which to open the unhidden container 200, including holes cut in the front face of the unhidden container 200, a hollowed-out area to insert a user's fingers into the front face of the unhidden container 200, and the like.

The furniture apparatus 20 may be configured such that a the hidden container 205 may be located within the enclosure formed by the frame 210 that is configured to receive the unhidden container 200. In such embodiments, the frame 210 may include one or more protrusions and/or support ledges upon which the hidden container may rest. Further, the hidden container may include one or more wings, protrusions, and/or other like members that allow the hidden container 205 to rest on the one or more protrusions inside the enclosure formed by the frame 210. In some embodiments, when resting on the one or more protrusions inside the enclosure formed by the frame 210, the hidden container 205 may be hidden in the enclosure with the unhidden container 200 when the unhidden container 200 is attached to the enclosure. Further, the hidden container 205 may have a cover 204 associated therewith, that allows the hidden container 205 to remain hidden when the unhidden container 200 is removed from the frame 210.

Figure 6:
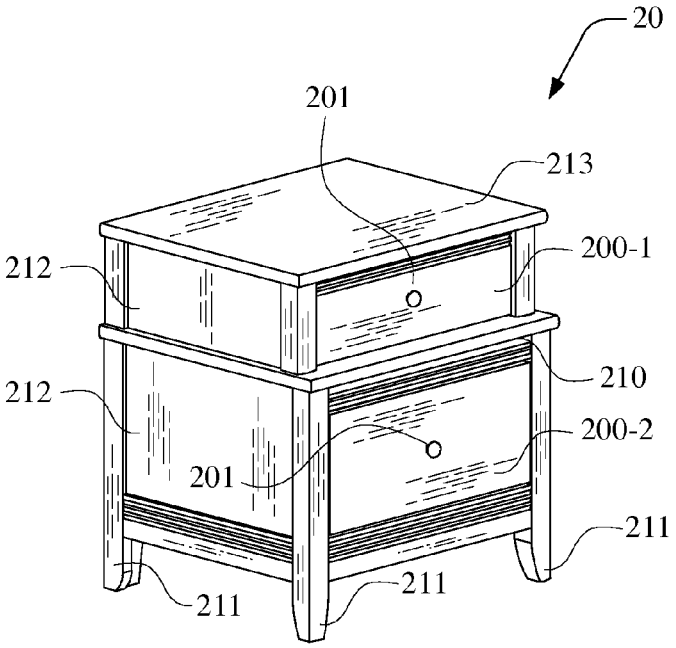
FIG. 6 is a front, right perspective view of a furniture apparatus including at least one secret and/or hidden container in a closed position according to another example embodiment.
Figure 7:
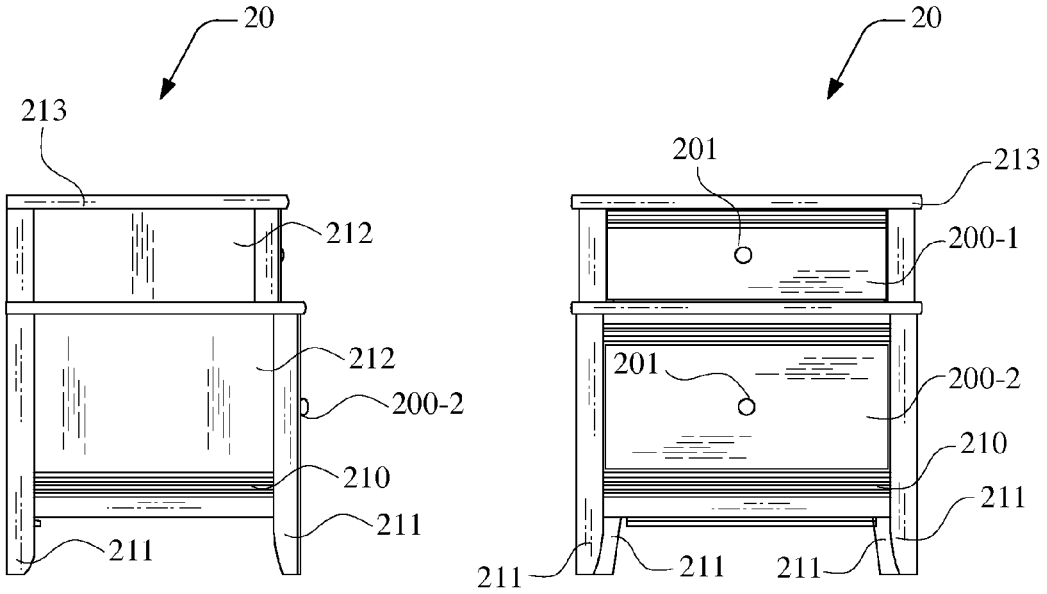
FIG. 7 is a side and front perspective view of the furniture apparatus including at least one secret and/or hidden container of FIG. 6.
Figure 8:
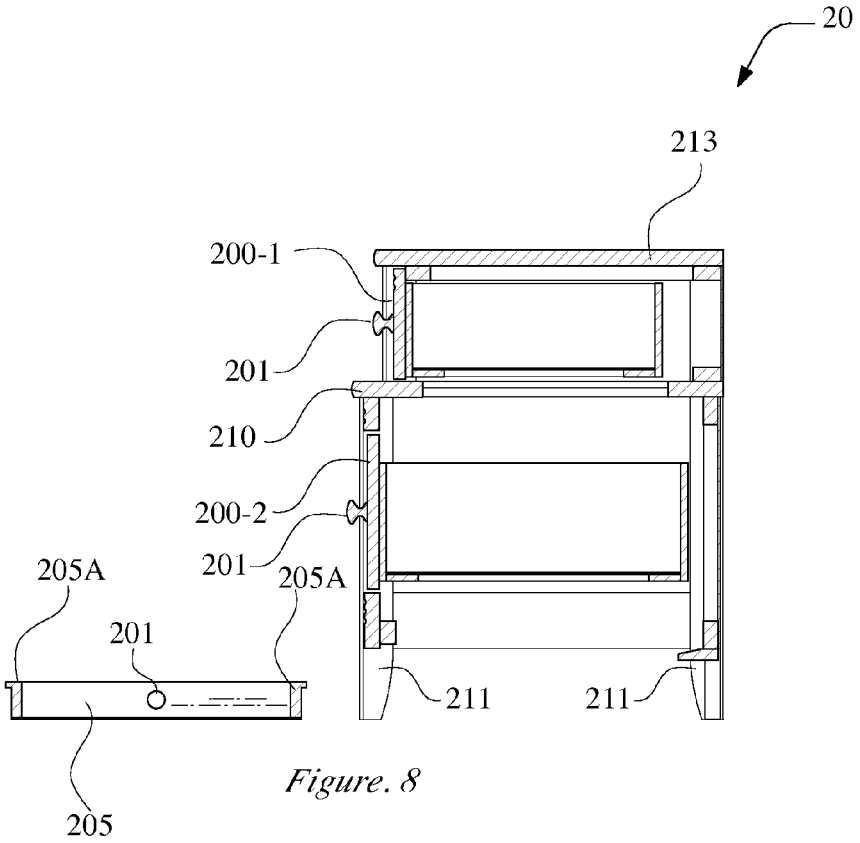
FIGS. 8 and 9 are side sectional views of a furniture apparatus according to other example embodiments.
Figure 9:
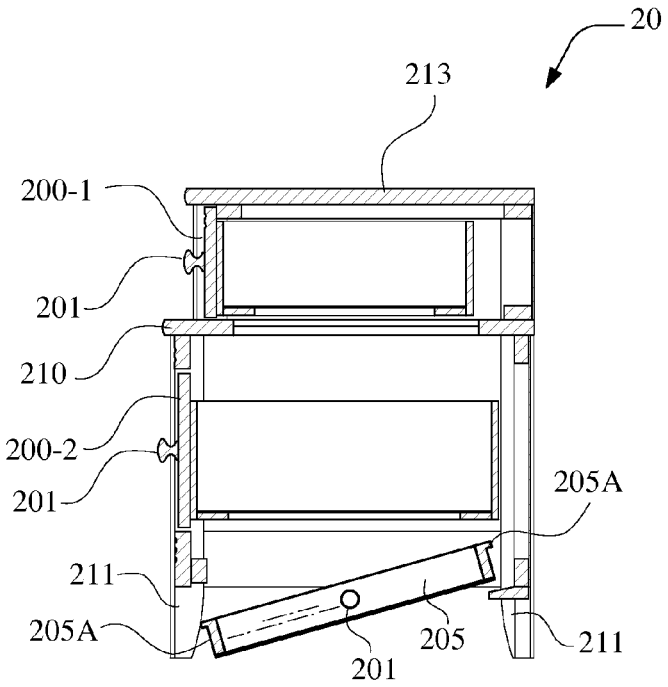

FIG. 6 is a front, right perspective view of a furniture apparatus 20 including unhidden containers 200 and at least one hidden container 205 in a closed state according to another example embodiment. FIG. 7 is a side and front perspective view of the furniture apparatus 20 of FIG. 6. FIGS. 8 and 9 are side sectional views of a furniture apparatus 20 according to other example embodiments.

Referring to FIGS. 6 to 9, the furniture apparatus 20 may include a hidden container 205 underneath the frame 210. For example, a bottom portion of the frame 210 (i.e., an undercarriage of the frame 210) may include one or more protrusions, sliders, latches, hooks, and/or any other like mechanism that allows the hidden container 205 to be supported by or otherwise be received by the undercarriage of the frame 210 (not shown). The hidden container 205 may be hidden, concealed, or otherwise made invisible by placing the hidden container 205 underneath the frame 20. Further, the furniture apparatus 20 may include one or more unhidden containers 200.

The unhidden containers 200 and/or the hidden container 205 may be the same or similar to the unhidden container 100 and/or the hidden container 105 discussed previously.

The frame 210 includes side panels 212 and a top surface 213. Together, the side panels 212 and top surface 213 of the frame 210 form an enclosure that holds or otherwise includes hidden container 205 and a top one of the unhidden containers 200 (i.e., unhidden containers 200-1). The frame 210 includes an enclosure that holds or otherwise includes a bottom one of the unhidden containers 200 (i.e., unhidden containers 200-2). The frame 210, legs 211, side panels 212, and top 213 may be the same or similar to frame 110, legs 111, side panels 112, and top 113, respectively.

As shown in FIGS. 6 to 9, each of the unhidden containers 200 may be in a closed state. When in the closed state, the top one of the unhidden containers 200 (i.e., unhidden container 200-1) together with the top surface 213 forms a first enclosure capable of storing objects. Additionally, a bottom one of the unhidden containers 200 (i.e., unhidden container 200-2) together with the top one of the unhidden containers 200 form a second enclosure capable of storing objects.

According to various embodiments, the hidden container 205 may be located within the enclosure formed by the frame 210 that is configured to receive the unhidden container 205. In such embodiments, the frame 210 may include one or more protrusions and/or support ledges upon which the hidden container 205 may rest. In such embodiments, the hidden container 205 may include one or more wings, protrusions, and/or other like members that allow the hidden container 205 to rest on the one or more protrusions inside the enclosure formed by the frame 210. In some embodiments, when resting on the one or more protrusions inside the enclosure formed by the frame 210, the hidden container 205 may form an enclosure with the unhidden container 200 when the unhidden container 200 is in the closed state.

The hidden container 205 may be hidden, concealed, or otherwise made invisible by placing the hidden container 205 underneath the frame 210. In such embodiments, a bottom portion of the frame 210 (i.e., an undercarriage of the frame 210) may include one or more protrusions, sliders, latches, hooks, and/or any other like mechanism that allows the hidden container 205 to connect to or otherwise be received by the undercarriage of the frame 210.

Figure 10:
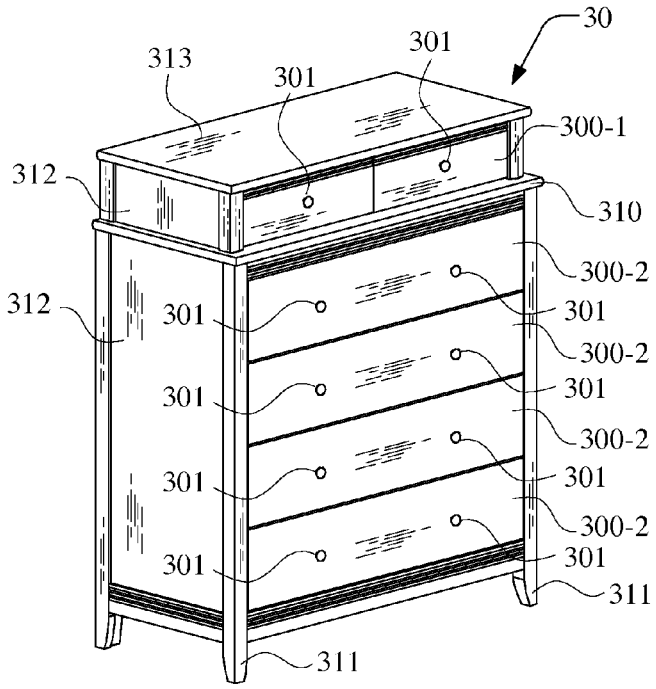
FIG. 10 is a front, right perspective view of a furniture apparatus including at least one secret and/or hidden container in a closed position according to another example embodiment.
Figure 11:
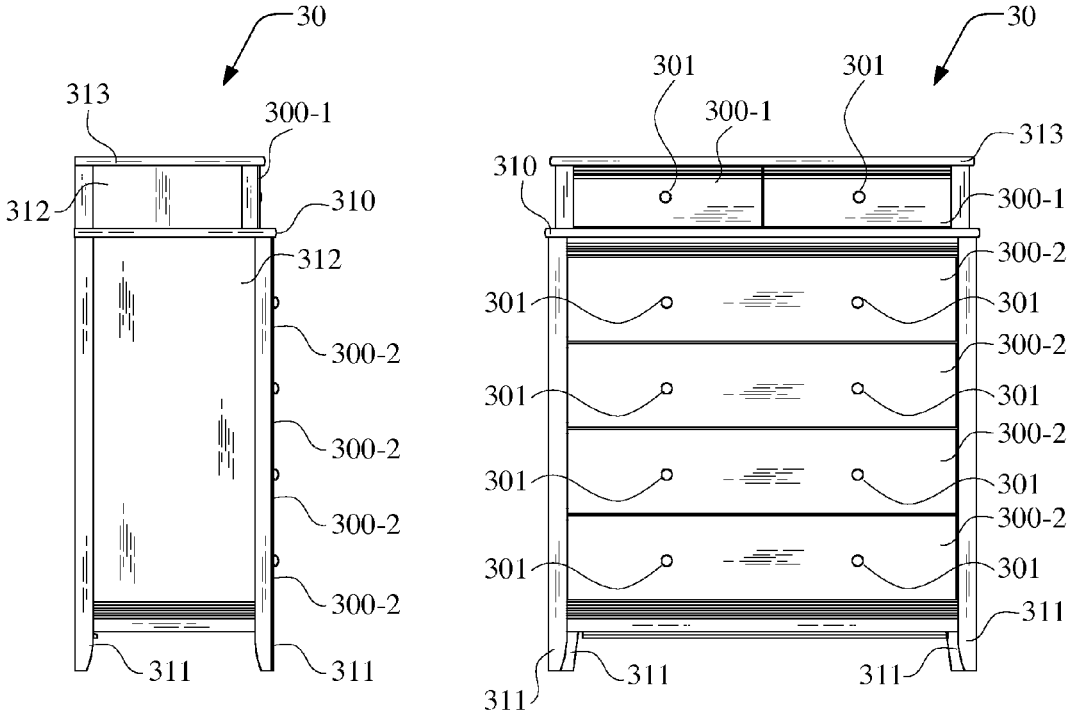
FIG. 11 is a side and front perspective view of the furniture apparatus including at least one secret and/or hidden container of FIG. 10.

FIG. 10 is a front, right perspective view of a furniture apparatus 30 including unhidden containers 300 and at least one hidden container 305 in a closed state according to another example embodiment. FIG. 11 is a side and front perspective view of the furniture apparatus 30.

Referring to FIGS. 10 and 11, the furniture apparatus 30 includes a plurality of unhidden containers 300, at least one hidden container 305 (not shown), frame 310, and legs 311. Each of the plurality of unhidden containers 300 includes a corresponding handle 301.

The frame 310 includes side panels 312 and a top surface 313. Together, the side panels 312 and top surface 313 of the frame 310 form an enclosure that holds or otherwise includes hidden container 305 (not shown) and/or top ones of the unhidden containers 300 (i.e., unhidden containers 300-1 as shown in FIGS. 5 and 6). The frame 310 also includes enclosures that holds or otherwise includes corresponding bottom ones of the unhidden containers 300 (i.e., unhidden containers 300-2 as shown in FIGS. 5 and 6). The frame 310, legs 311, side panels 312, and top 313 may be the same or similar to frame 110, legs 111, side panels 112, and top 113, respectively.

Each of the plurality of unhidden containers may be in a closed state. When in the closed state, top ones of the unhidden containers 300 (i.e., unhidden containers 300-1) together with the top surface 313 form enclosures that fulfill a storage function of the furniture apparatus 30. Additionally, bottom ones of the unhidden containers 300 (i.e., unhidden containers 300-2) together with the top ones of the unhidden containers 300 and/or other bottom ones of the unhidden containers 300 form enclosures that fulfills a storage function of the furniture apparatus 30. The unhidden containers 300 and/or the hidden container 305 (not shown) may be the same or similar to the unhidden container 100 and/or the hidden container 105 as discussed previously with regard to FIGS. 1 and 2. Furthermore, handles 301 may be the same or similar to the handle 101.

According to various embodiments, the hidden container 305 may be located within the any one of the enclosures formed by the frame 310 that are configured to receive any of the plurality of unhidden containers 300. In such embodiments, the frame 310 may include, within one of the enclosures for receiving an unhidden container 300, one or more protrusions and/or support ledges upon which the hidden container 305 may rest (not shown). In such embodiments, the hidden container 305 may include one or more wings, protrusions, and/or other like members that allow the hidden container 305 to rest on the one or more protrusions inside the enclosure formed by the frame 310. In some embodiments, when resting on the one or more protrusions inside the enclosure formed by the frame 310, the hidden container 305 may be hidden when the corresponding unhidden container 300 is in the frame 310, and the unhidden container 300 may be removed to expose the hidden container 305.

According to other example embodiments, the hidden container 305 may be hidden, concealed, or otherwise made invisible by placing the hidden container 305 underneath the frame 310. In such embodiments, a bottom portion of the frame 310 (i.e., an undercarriage of the frame 310) may include one or more protrusions, sliders, latches, hooks, and/or any other like mechanism that allows the hidden container 305 to connect to or otherwise be received by the undercarriage of the frame 310 (not shown).

Figure 12:
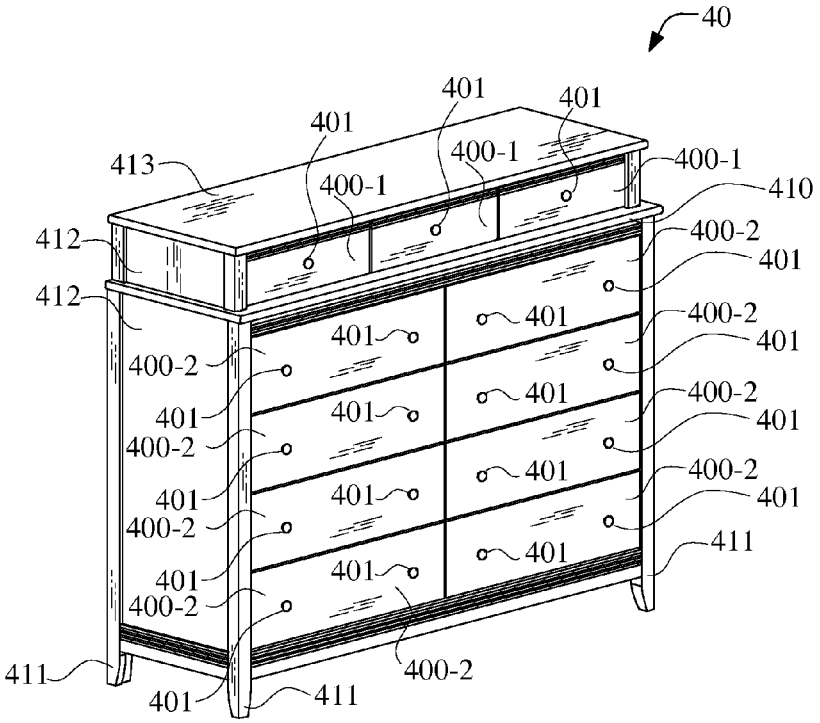
FIG. 12 is a front, right perspective view of a furniture apparatus including at least one secret and/or hidden container in a closed position according to another example embodiment.
Figure 13:
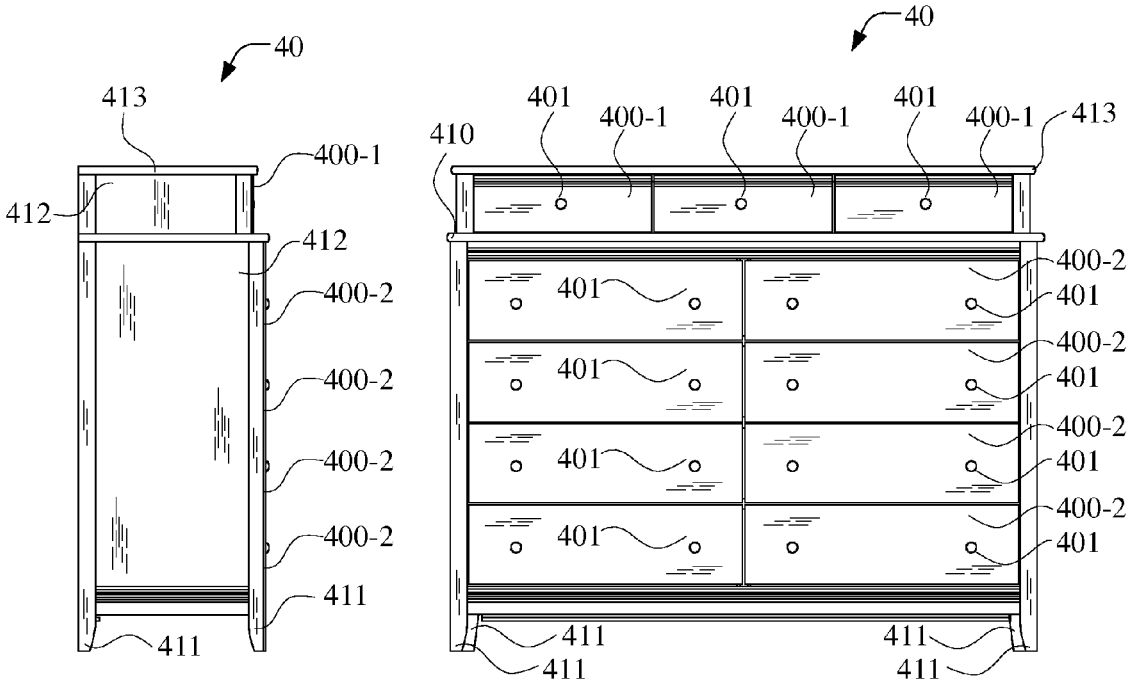
FIG. 13 is a side and front perspective view of the furniture apparatus including at least one secret and/or hidden container of FIG. 12.

FIG. 12 is a front, right perspective view of a furniture apparatus 40 including unhidden containers 400 and at least one hidden container 405 in a closed state according to another example embodiment. FIG. 13 is a side and front perspective view of the furniture apparatus 40.

Referring to FIGS. 12 and 13, the furniture apparatus 40 includes a plurality of unhidden containers 400, at least one hidden container 405 (not shown), frame 410, and legs 411. Each of the plurality of unhidden containers 400 includes a corresponding handle 401.

The frame 410 includes side panels 412 and top surface 413. Together, the side panels 412 and the top surface 413 of the frame 410 form an enclosure that holds or otherwise includes hidden container 405 (not shown) and top ones of the unhidden containers 400. The frame 410 includes enclosures that hold or otherwise include bottom ones of the unhidden containers 400 (i.e., unhidden containers 400-2). The frame 410, legs 411, side panels 412, and top 413 may be the same or similar to frame 110, legs 111, side panels 112, and top surface 113, respectively.

Each of the plurality of unhidden containers 400 may be in a closed state. When in the closed state, top ones of the unhidden containers 400 (i.e., unhidden containers 400-1) together with the top surface 413 forms first enclosures that fulfill a storage function of the furniture apparatus 40. Additionally, bottom ones of the unhidden containers 400 (i.e., unhidden containers 400-2) together with the top ones of the unhidden containers 400 and/or other bottom ones of the unhidden containers 400 form enclosures that fulfill a storage function of the furniture apparatus 40. The unhidden containers 400 and/or the hidden container 405 (not shown) may be the same or similar to the unhidden container 100 and/or the hidden container 105 as discussed previously. Furthermore, handles 401 may be the same or similar to the handle 101.

According to various embodiments, the hidden container 405 may be located within any of the enclosures formed by the frame 410 that are configured to receive any of the plurality of unhidden containers 405. In such embodiments, the frame 410 may include, within at least one of the enclosures for receiving one of the unhidden containers 400, one or more protrusions and/or support ledges upon which the hidden container 405 may rest (not shown). In such embodiments, the hidden container 405 may include one or more wings, protrusions, and/or other like members that allow the hidden container 405 to rest on the one or more protrusions inside the enclosure formed by the frame 410. In some embodiments, when resting on the one or more protrusions inside the enclosure formed by the frame 410, the hidden container 405 may be hidden when the unhidden container 400 is within the enclosure and exposed when a corresponding one of the unhidden containers 400 located above the hidden container 405 is removed.

According to other example embodiments, the hidden container 405 may be hidden, concealed, or otherwise made invisible by placing the hidden container 405 underneath the frame $10. In such embodiments, a bottom portion of the frame 410 (i.e., an undercarriage of the frame 410) may include one or more protrusions, sliders, latches, hooks, and/or any other like mechanism that allows the hidden container 405 to connect to or otherwise be received by the undercarriage of the frame 410 (not shown).

Figure 14:
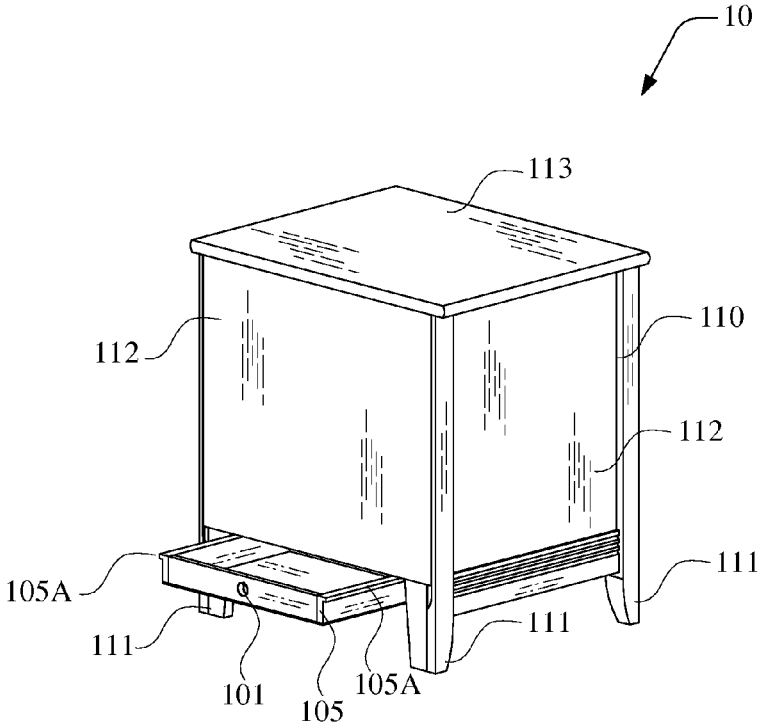
FIG. 14 is a back, left perspective view of the furniture apparatus of FIGS. 1 and 2 with an exposed secret and/or hidden container according to an example embodiment.
Figure 15:
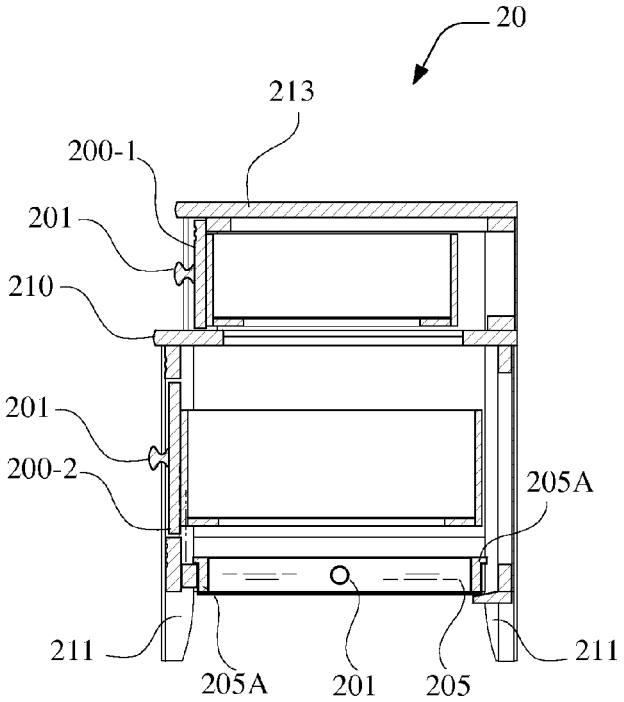
FIG. 15 is a side perspective view of a furniture apparatus according to an example embodiment.

FIG. 14 is a back, left perspective view of the furniture apparatus 10' according to an example embodiment and FIG. 15 is a side perspective view of a furniture apparatus 10" according to an example embodiment.

Referring to FIGS. 14 and 15, the hidden container 105 may be located underneath the frame 110. According to various embodiments, a bottom portion of the frame 110 may include one or more runners, support ledges and/or protrusions, sliders, latches, hooks, and/or any other like mechanism that allows the hidden container to connect to or otherwise be received by the bottom portion of the frame 110 (not shown). In various embodiments, the hidden container 105 may include one or more wings, protrusions, and/or other like members 105A that allow the hidden container 105 to rest on the one or more protrusions and or runners underneath the frame 110 (not shown).

According to some example embodiments, the hidden container 105 is configured to be drawn out horizontally in a same or similar fashion as discussed previously with regard to the unhidden container 100. Alternatively, in other example embodiments, the distance between the support ledges and the bottom of the bottom unhidden container 100 may be such that the hidden container may be lifted via a first side, until a second side of the hidden container 105 rests on the support ledges, and then the first side of the hidden container may be lowered to place the hidden container 105 on the support ledges.

Furthermore, according to various embodiments, the bottom portion of the frame 110 may be constructed or otherwise manufactured in such a way that, when the hidden container 105 is received by the bottom portion of the frame 110 (i.e., when the hidden container 105 is in a closed state), the hidden container 105 is hidden and/or concealed from view or otherwise invisible. In such embodiments, the hidden container 105 may be concealed by the legs 111 and/or the side panels 112.

Alternatively, as illustrated in FIG. 15, the hidden container 105 may be configured to be drawn out horizontally from the frame in a different direction from which the unhidden container 100 is drawn out from the frame 110. Therefore, as illustrated in FIG. 16, the hidden container 105 may not need to be hidden, but may be designed in a similar manner as the unhidden container 100 but configured to be invisible when the frame 100 is placed against an object (not shown).

However, according to various embodiments, the hidden container 105 and the unhidden container 100 may be configured to be drawn out horizontally in a same direction. It should also be noted that the protrusions and/or runners that receive the hidden container 105 may also allow the hidden container to attach and detach from the frame 110. Furthermore, in various embodiments, the hidden container 105 may be removed and/or detached from the frame 110 using any other type of manipulation other than using a drawing-out motion.

Furthermore, according to various embodiments, a furniture object that does not include a hidden container may be converted into the furniture apparatus 10 by installing a set of runners to an undercarriage of the furniture object, and attaching the hidden container to the set of runners, and when attached to the set of runners. The set of runners may be installed to the undercarriage of a furniture object using any known fastening device (e.g., nails, screws, and the like), an adhesive (e.g., glue, epoxy resin, and the like), and/or by any other means for fastening one object to another object. The set of runners may be the same or similar to the runners and/or sliders discussed previous with regard to FIGS. 1 and 2.

Figure 16:
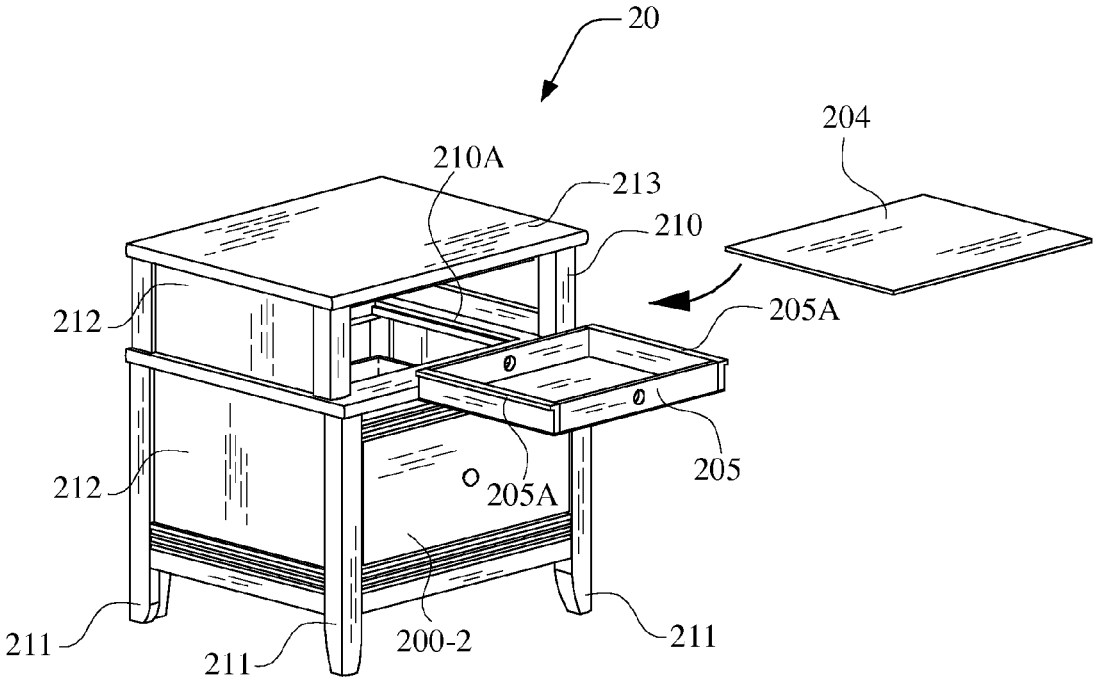
FIG. 16 is a front, left perspective view of the furniture apparatus of FIGS. 6 and 7 with an exposed secret and/or hidden container according to an example embodiment.

FIG. 16 is a front, left perspective view of the furniture apparatus 20 of FIGS. 6 and 7 with the hidden container 205 exposed according to an example embodiment.

As shown, the hidden container 205 is shown as being located outside of the frame 210, which may be referred to as being in an open state and/or open position. In order to place the hidden container 205 in the open state, according to various embodiments, the unhidden container 200 may be removed or otherwise detached from the frame 210. In order to place the hidden container 205 in the closed state, a user may place the hidden container 205 inside the enclosure formed by the frame 210. In such embodiments, the hidden container 205 may be configured to rest within the enclosure formed by the frame 210 that holds the unhidden container 200. In such embodiments, the frame 210 may include one or more protrusions, support ledges, and/or runners 210A upon which the hidden container 205 may rest. In various embodiments, the hidden container 205 may include one or more wings, protrusions, and/or other like members 205A that allow the hidden container 205 to rest on the protrusions and/or runners 210A. When resting on the one or more protrusions and/or runners, the unhidden container 200 may be configured to slide over or otherwise cover the hidden container 205 when the unhidden container 200 is received by the frame 210. Thus, when the unhidden container 205 is received by or otherwise inserted into the enclosure formed by the frame 210, the unhidden container 200 may hide the hidden container 205.

Figure 17:
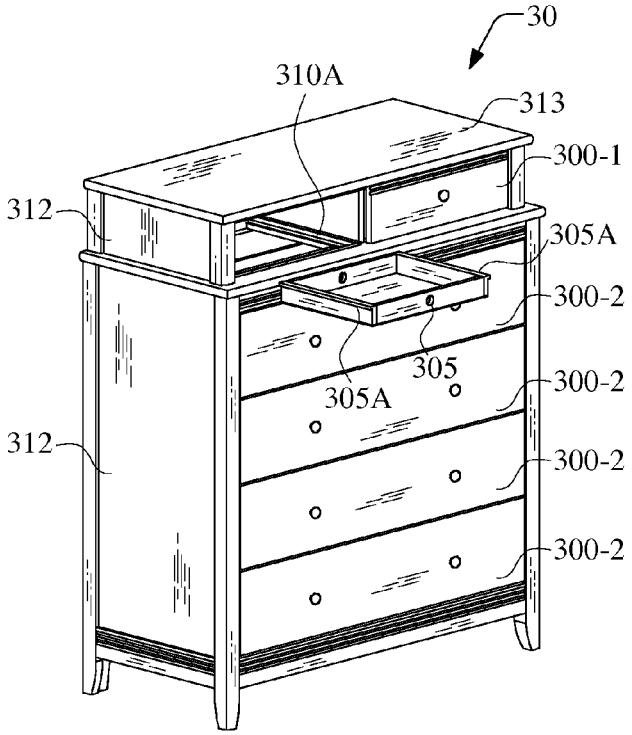
FIG. 17 is a front, left perspective view of the furniture apparatus of FIGS. 10 and 11 with an exposed secret and/or hidden container according to an example embodiment.
Figure 18:
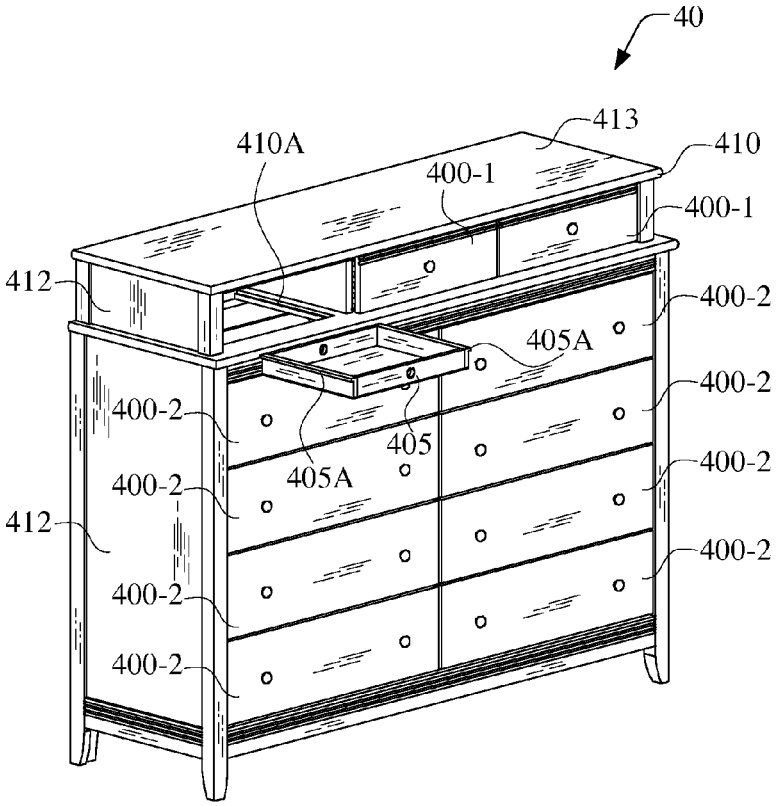
FIG. 18 is a front, left perspective view of the furniture apparatus of FIGS. 12 and 13 with an exposed secret and/or hidden container according to an example embodiment.

FIG. 17 is a front, left perspective view of the furniture apparatus 30 of FIGS. 10 and 11 with the hidden container 305 exposed according to an example embodiment. FIG. 18 is a front, left perspective view of the furniture apparatus 40 of FIGS. 12 and 13 with the hidden container 405 exposed according to an example embodiment.

Referring to FIG. 17, the hidden container 305 is shown as being located outside of the frame 310, which may be referred to as being in an open state and/or open position. In order to place the hidden container 305 in the open state, according to various embodiments, the unhidden container 300 may be removed or otherwise detached from the frame 310. In order to place the hidden container 305 in the closed state, a user may place the hidden container 305 inside the enclosure formed by the frame 310. In such embodiments, the hidden container 305 may be configured to rest within the enclosure formed by the frame 310 that holds the unhidden container 300. In such embodiments, the frame 310 may include one or more protrusions and/or runners 310A upon which the hidden container 305 may rest. In various embodiments, the hidden container 305 may include one or more wings, protrusions, and/or other like members 305A that allow the hidden container 205 to rest on the protrusions, support ledges and/or runners 310A. When resting on the one or more protrusions, support ledges, and/or runners, the unhidden container 300 may be configured to slide over or otherwise cover the hidden container 305 when the unhidden container 300 is received by the frame 310. Thus, when the unhidden container 305 is received by or otherwise inserted into the enclosure formed by the frame 310, the unhidden container 300 may form another enclosure with the hidden container 305. In such embodiments, a bottom portion of the unhidden container 300 may be a top portion of the other enclosure.

It should be noted that, although FIG. 17 shows the hidden container 305 being inserted/removed from an enclosure formed by left portion of the frame 310, the example embodiments are not limited thereto. According to various example embodiments, the hidden container 305 being inserted/removed into/from any of the enclosures formed by the frame 310 that are able to receive an unhidden container 300.

Referring to FIG. 18, the hidden container 405 is shown as being located outside of the frame 410, which may be referred to as being in an open state and/or open position. In order to place the hidden container 405 in the open state, according to various embodiments, the unhidden container 400 may be removed or otherwise detached from the frame 310. In order to place the hidden container 405 in the closed state, a user may place the hidden container 405 inside the enclosure formed by the frame 410. In such embodiments, the hidden container 405 may be configured to rest within the enclosure formed by the frame 410 that holds the unhidden container 400. In such embodiments, the frame 410 may include one or more protrusions, support ledges, and/or runners 410A upon which the hidden container 305 may rest. In various embodiments, the hidden container 405 may include one or more wings, protrusions, and/or other like members 405A that allow the hidden container 405 to rest on the protrusions and/or runners 410A. When resting on the one or more protrusions and/or runners, the unhidden container 400 may be configured to slide over or otherwise cover the hidden container 405 when the unhidden container 400 is received by the frame 410. Thus, when the unhidden container 405 is received by or otherwise inserted into the enclosure formed by the frame 410, the unhidden container 400 may form another enclosure with the hidden container 405. In such embodiments, a bottom portion of the unhidden container 400 may be a top portion of the other enclosure.

The example embodiment shown by FIG. 18 may be the same or similar to the example embodiment shown by FIGS. 16 and 17, and the example embodiment shown by FIG. 18 may operate in a same or similar manner as the example embodiment as discussed with regard to FIGS. 17 and 18. It should be noted that, although FIG. 18 shows the hidden container 405 being inserted/removed from an enclosure formed by left portion of the frame 410, the example embodiments are not limited thereto. According to various example embodiments, the hidden container 405 being inserted/removed into/from any of the enclosures formed by the frame 410 that are able to receive an unhidden container 400.

Figure 19:
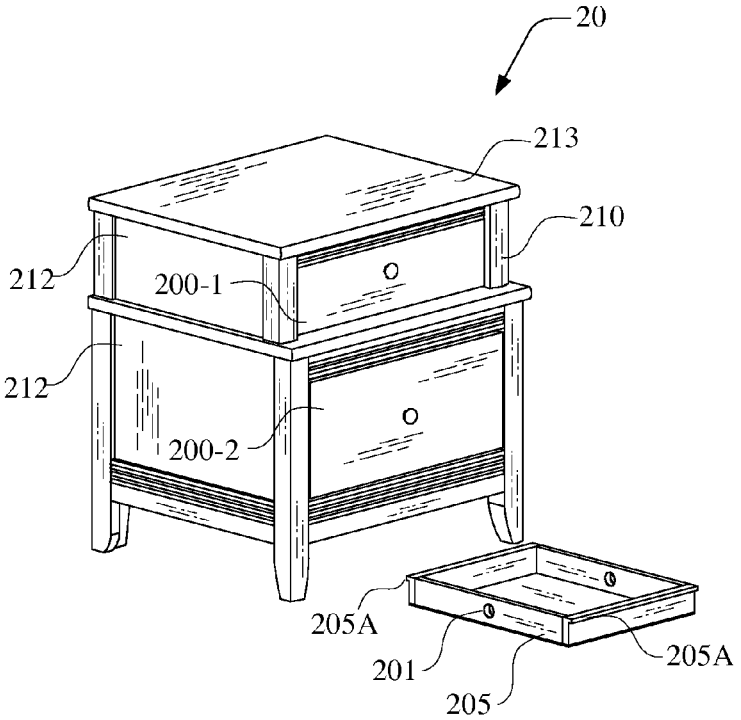
FIG. 19 is a front, left perspective view of the furniture apparatus of FIGS. 6 and 7 with an detached secret and/or hidden container according to another example embodiment.
Figure 20:
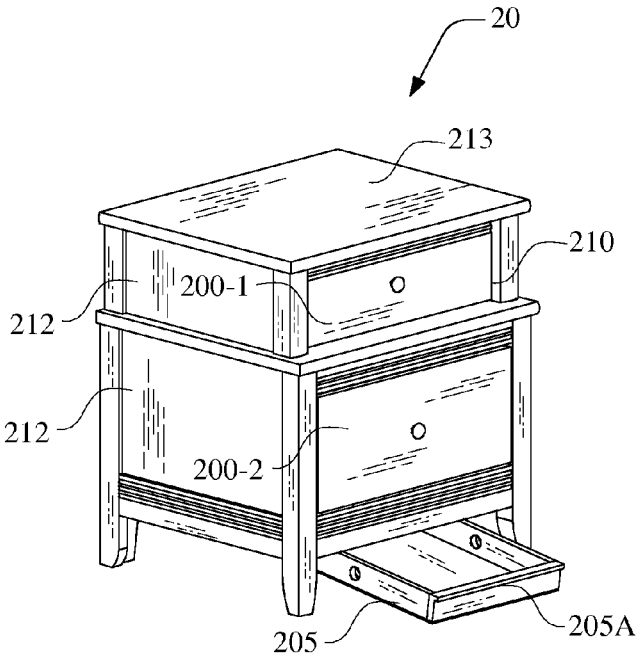
FIG. 20 is a front, left perspective view of the furniture apparatus of FIGS. 6 and 7 with the secret and/or hidden container being placed in a closed position according to the example embodiment of FIG. 18.

FIG. 19 is a front, left perspective view of the furniture apparatus 20 of FIGS. 6 and 7 including unhidden containers 200 and at least one hidden container 205 according to another example embodiment. FIG. 20 is a front, left perspective view of the furniture apparatus 20 with the hidden container 205 being placed in a closed state.

Referring to FIGS. 19 and 20, the hidden container 205 is located underneath the frame 210. According to various embodiments, a bottom portion of the frame 210 may include one or more runners, support ledges and/or protrusions, sliders, latches, hooks, and/or any other like mechanism that allows the hidden container to connect to or otherwise be received by the bottom portion of the frame 210 (not shown). According to various example embodiments, the hidden container 205 may include one or more wings, protrusions, and/or other like mechanisms 205A that allow the hidden container 205 to attach to or otherwise be received by the bottom portion and/or undercarriage of the frame 210. Furthermore, according to various embodiments, the bottom portion of the frame 210 may be constructed or otherwise manufactured in such a way that, when the hidden container 205 is received by the bottom portion of the frame 210 (i.e., when the hidden container 210 is in a closed state), the hidden container 205 is hidden and/or concealed from view or otherwise invisible.

In such embodiments, the hidden container 205 may be concealed by the legs 211, the side panels 212, and/or the bottom unhidden container 200-2. It should also be noted that the protrusions and/or runners of the undercarriage of the frame 210 that receive the hidden container 205 may also allow the hidden container to attach and detach from the frame 210. Furthermore, in various embodiments, the hidden container 205 may be removed and/or detached from the frame 210 using any other type of manipulation other than using a drawing-out motion. For example, in some example embodiments, the distance between the support ledges and the bottom of the bottom unhidden container 200-2 may be such that the hidden container 205 may be lifted via a first side, until a second side of the hidden container 205 rests on the support ledges, and then the first side of the hidden container may be lowered to place the hidden container 205 on the support ledges.

Furthermore, according to various embodiments, a furniture object that does not include a hidden container may be converted into the furniture apparatus 20 by installing a set of runners to an undercarriage of the furniture object, and attaching the hidden container to the set of runners, and when attached to the set of runners. The set of runners may be installed to the undercarriage of a furniture object using any known fastening device (e.g., nails, screws, and the like), an adhesive (e.g., glue, epoxy resin, and the like), and/or by any other means for fastening one object to another object.

Figure 21:
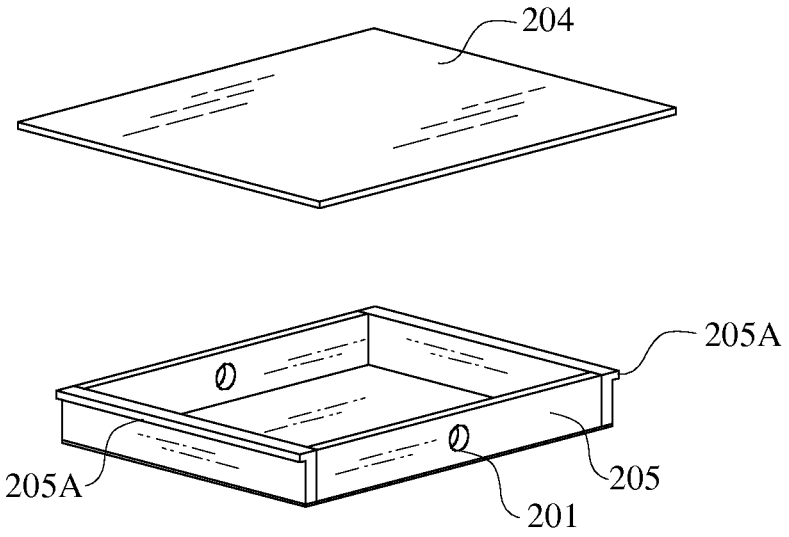
FIG. 21 illustrates a hidden container according to an example embodiment.

FIG. 21 illustrates a hidden container according to an example embodiment.

Referring to FIG. 21, the hidden container 205 may include four side surfaces connected together to form a rectangular shape, and a bottom surface attached to the four side surfaces. The hidden container 205 may include protrusions 205A extending from one of the side and front and rear surfaces thereof, that allow the hidden container 205 to be supported by corresponding support ledges in the frame. However, example embodiments are not limited thereto, for example, in some other example embodiments, the bottom surface may be supported by the support ledges without the use of the protrusions. The hidden container 205 may have a cover 204 associated therewith that allows the hidden container 205 to remain hidden even when the unhidden container thereabove is removed from the frame. The hidden container 205 may then be removed via grasping finger holes 201 therein.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A furniture apparatus comprising:

a frame;

an unhidden container configured to be at least drawn out horizontally in a first direction from the frame when transitioning from a closed state to an open state within an opening formed within the frame; and a hidden container configured to rest on a set of support ledges attached to a bottom portion of the frame such that the hidden container is relatively lower on the frame than the unhidden container, the hidden container being configured to transition between an open state and a closed state, the hidden container being visible when the hidden container is in the open state, and the hidden container being hidden from view when the hidden container is in the closed state.

2. The furniture apparatus of claim 1, wherein the unhidden container is a container that is visible when in each of the open state and the closed state, the unhidden container removable from the frame by transitioning the unhidden container beyond the open state.

3. The furniture apparatus of claim 1, wherein the hidden container is configured to be at least drawn out horizontally in the first direction from the frame when transitioning from the closed state to the open state.

4. The furniture apparatus of claim 1, wherein the hidden container is configured to be at least drawn out horizontally in a second direction from the frame when transitioning from the closed state to the open state, and the first direction is a different direction from the second direction.

5. The furniture apparatus of claim 1, wherein the frame includes a set of runners configured to allow the unhidden container to be at least drawn out horizontally, and the unhidden container forms a first enclosure with the frame when the unhidden container is received by the opening.

6. The furniture apparatus of claim 5, wherein one or more of the support ledges and the hidden container include a sliding mechanism configured to allow the hidden container to slide horizontally.

7. The furniture apparatus of claim 5, wherein the hidden container includes one or more protruding members protruding from a body of the hidden container, the hidden container configured to selectively rest on the support ledges via the one or more protruding members.

8. The furniture apparatus of claim 7, wherein, when the hidden container rests on the support ledges, the hidden container forms a second enclosure underneath the first enclosure such that the second enclosure is hidden from view when the first enclosure is within the frame.

9. The furniture apparatus of claim 8, wherein, when resting in the opening, the one or more protruding members of the hidden container are configured to rest on the support ledges.

10. The furniture apparatus of claim 1, wherein the unhidden container is one of a plurality of unhidden containers that each form a first enclosure, and the frame includes a plurality of openings therein each configured to receive a corresponding one of the plurality of unhidden containers, each of the plurality of unhidden containers being visible in each of the open state and the closed state.

11. The furniture apparatus of claim 10, wherein at least one of the unhidden containers is removable from the frame, and the at least one hidden container is configured to draw out at least horizontally in a direction from the frame when changing from the closed state to the open state.

12. The furniture apparatus of claim 11, wherein the at least one hidden container is configured to draw out in a different direction from the unhidden containers.

13. The furniture apparatus of claim 11, wherein each of the plurality of openings includes a set of runners configured to allow each of the plurality of unhidden containers to be at least drawn out horizontally, and the at least one hidden container is configured to rest on support ledges attached to an undercarriage of the frame.

14. The furniture object of claim 13, wherein the at least one hidden container includes one or more protruding members protruding from a body thereof, the hidden container configured to selectively rest on the support ledges via the one or more protruding members.

15. The furniture apparatus of claim 14, wherein, when the at least one hidden container rests on the support ledges, the at least one hidden container forms a second enclosure underneath one of the first enclosures such that the second enclosure is hidden from view when the first enclosure is within the frame.

16. The furniture apparatus of claim 15, wherein the one of the protruding members and a bottom surface of the hidden container are configured to rest on the support ledges.

17. The furniture apparatus of claim 13, wherein the at least one hidden container is configured to attach to the support ledges.

18. A method of constructing a furniture apparatus including an unhidden container and a hidden container, the hidden container being concealed from view when the hidden container is in a closed state, the method comprising:

placing the unhidden container in an opening formed in the furniture apparatus;

installing a set of support ledges to an undercarriage of the furniture apparatus; and placing the hidden container on the set of support ledges such that the hidden container is relatively lower on a frame of the furniture apparatus than the unhidden container while the hidden container rests on the set of support ledges and is hidden when viewing the furniture apparatus from a front perspective.

19. The method of claim 18, wherein the hidden container is hidden when the at least one unhidden drawer is within the frame of the furniture apparatus.

20. A furniture apparatus comprising:

a frame including an opening configured to receive an unhidden container and a hidden container, wherein the unhidden container is configured to selectively detach from the frame such that, when the unhidden container is attached to the frame, the hidden container is hidden from view inside the frame beneath the unhidden container, and when the unhidden container is detached from the frame, the hidden container is exposed.

* * * * *